US005123472A

United States Patent [19]

Nagashima et al.

[11] Patent Number: 5,123,472

[45] Date of Patent: Jun. 23, 1992

[54] APPARATUS FOR LIFTING AND TILTING SLATS IN A VENETIAN BLIND

[75] Inventors: Masahiro Nagashima; Kazuya Hayashi; Tadashi Inaba, all of Tokyo, Japan

[73] Assignee: Toso Company, Limited, Tokyo, Japan

[21] Appl. No.: 774,829

[22] Filed: Oct. 11, 1991

[30] Foreign Application Priority Data

Oct. 11, 1990 [JP] Japan ..... 2-105981[U]
Oct. 11, 1990 [JP] Japan ..... 2-105982[U]
Oct. 11, 1990 [JP] Japan ..... 2-270432

[51] Int. Cl.[5] ..... E06B 9/30
[52] U.S. Cl. ..... 160/170; 160/176.1
[58] Field of Search ..... 160/170, 168.1, 173, 160/176.1, 178.1, 177

[56] References Cited

U.S. PATENT DOCUMENTS 2,737,235 3/1956 Hediger ..... 160/170
3,260,302 7/1966 Griesser ..... 160/170

FOREIGN PATENT DOCUMENTS 118893 3/1962 Japan .
127596 4/1963 Japan .
317038 3/1953 Switzerland ..... 160/170

*Primary Examiner*—Blair M. Johnson
*Attorney, Agent, or Firm*—Birch, Stewart, Kolasch & Birch

[57] ABSTRACT

According to the present invention, there is provided an apparatus for lifting and tilting slats in a venetian blind, comprising: a head box; a rotating shaft; ladder drums rotating together with the shaft; drum holders for supporting the ladder drums; ladder rings of an open ring shape and fitted around each of the ladder drums; ladder cords being put on, and secured to, each of the ladder rings; lifting drums; lift cords, wound around each of the lifting drums; slats; and elements for stopping the rotation of the shaft. The apparatus is characterized in that the elements for stopping the rotation of the shaft comprises: a stopper holder on a head box; a drum stopper of a ring shape, axially not slidably, but rotatably, attached to the stopper holder; a stop ring of a ring shape, axially slidably, but not rotatably, attached to the stopper holder; and a spring for axially pressing the stop ring against the drum stopper, the drum stopper and the stop ring having teeth formed on the mutually opposite ends of the drum stopper and the stop ring so that the teeth are engageable with each other. The lifting drum and the drum stopper are engaged so that the drum stopper rotates together with the lifting drum. The lift cord is put on the stop ring, and is hung downward.

6 Claims, 5 Drawing Sheets

APPARATUS FOR LIFTING AND TILTING SLATS IN A VENETIAN BLIND

BACKGROUND OF THE INVENTION

1. Field of the Invention

The present invention relates to improvements in an apparatus for lifting and tilting slats of a slat-ladder in a venetian blind, of a type in which slats are supported by ladder cords, and a motion of either lifting or lowering lift cords, or tapes, enables the slats, first, to be tilted, then, to be lifted or lowered.

2. Description of the Prior Art

Prior art apparatus for lifting and tilting slats of a slat-ladder in a venetian blind, of the type described above, performs the tilting operation in a manner that: the ladder cords are respectively put on, and secured to, each of ladder rings, with the mid portion of the ladder cords positioned on the top of the ladder rings; each of the ladder rings is slippably fitted around each of ladder drums; the ladder drums are arranged to rotate together with a rotating shaft; then, when the shaft is rotated together with the ladder drums, the ladder rings first rotate together with the ladder drums, and thereby the ladder cords are moved together with the ladder drums around the shaft, with the front and the rear sides of the ladder cords shifted to the opposite directions with each other, so that the slats are tilted; when the slats are tilted to a limit, the ladder rings are arranged to engage with a copper and do not rotate any further while starting slippage around the ladder drums, so that the ladder cords are no longer moved around the shaft, and thereby the slats are not tilted any further. Then, the prior art apparatus described above, proceeds to the lifting operation following the end of the tilting operation described above, in a manner that: while the ladder cords stop moving and the tilting motion comes to an end, the lift cords, or tapes, continue to be lifted or lowered so as to lift or lower the ladder, as the shaft continues to be rotated together with lifting drums around which the lift cords are wound for lifting and rewound for lowering. The prior art apparatus described above is disclosed in Japanese Unexamined Utility Model Publication 63127596.

Another prior art mechanism for a venetian blind is disclosed in Japanese Unexamined Utility Model Publication 62118893, for stopping rotation of the rotating shaft when any of the lift cords is slackened. The disclosed mechanism comprises a ratchet wheel disposed on, and constituting a part of, a lifting drum cover which rotates together with the shaft, and a pawl disposed on a holder fixed to a head box so that the pawl may have a rocking motion in the radial direction of the ratchet wheel. The pawl is arranged so that the pawl is normally pressed on, and engaged with, the ratchet wheel, by a spring, and the lift cord is arranged to pass around the pawl. Thereby, when the lift cord is tightened, the pawl is pulled out of the ratchet wheel, and when the lift cord is slackened, the pawl is pressed back by the spring to engage with the ratchet wheel and to stop rotation of the shaft.

Among the components rotatably enclosed in the head box of typical apparatus for tilting and lifting the slats for a venetian blind, the lifting drum cover is largest in its width from the front to the rear, or outdoor, sides.

The shaft rotation stopping mechanism of the prior art apparatus, disclosed above, has a disadvantage in that, since the radially protruding ratchet wheel is disposed around the circumference of the lifting drum cover, and the pawl, radially engaging with the ratchet wheel, is disposed on the holder, the width from the front to the rear sides and the height, of the head box are relatively large in their sizes.

Therefore, smaller head boxes in their width from the front to the rear sides have been desired, since the smaller head boxes in their width from the front to the rear sides, have a better appearance, and are free from any installment space restriction. The present invention is made to satisfy such desire.

In order to obtain a venetian blind having a better appearance, the lift cords, hanging down from the head box, are typically aligned with the ladder cords respectively in line from the front to the rear sides. This alignment has been accomplished in conventional venetian blinds by an arrangement in which the ladder cords, respectively put on, and secured to, each of the ladder rings, hang downward directly from the secured positions on the ladder rings, while the lift cords are pulled around to the positions where the ladder cords hang downward.

The arrangement for the lift cords and the ladder cords, described above, was selected because an alternative, or opposite arrangement has a certain problem. The alternative arrangement is that the lift cords hang downward directly from the lifting drum, while the ladder cords are pulled around to the positions where the lift cords hang downward. The certain problem, described above, with the alternative arrangement, is that the lifting and lowering movements of the slats are significantly heavy, or unsmooth, because the fitting tightness between the ladder rings and the ladder drums of prior apparatus, is arranged to be always constant, while the resistance in the ladder cords becomes greater as they are pulled around, and subsequently, a tighter fitting is required between the ladder ring and the ladder drum for an unchanged lifting smoothness.

The arrangement with the lift cords pulled around, as described above, which is selected in preference to the alternative, as described above, also has a disadvantage in that, in the arrangement where the lift cords are pulled around, the operation of an uneven ladder lowering preventive mechanism, tends to be unreliable, or not very responsive, since the lift cords are arranged to be put on the pawl, which activates the uneven ladder lowering preventive mechanism, or the shaft rotation stopping mechanism, to stop the shaft rotation when the lift cord is slackened.

The prior art apparatus for lifting and tilting slats of a slat-ladder for a venetian blind, described above, has an arrangement in which, the fitting tightness between the ladder rings and the ladder drums is arranged to be constant, as described above, and, in addition, the shaft is required to be further rotated to lift or lower the slat-ladder after the ladder ring is stopped by the stopper, following the slat tilting motion.

Then, the prior art apparatus for lifting and tilting slats, described above, has another disadvantage in that, in case where the fitting tightness between the ladder rings and the ladder drums is set tighter for a better slat tilting responsiveness, the frictional resistance between the ladder rings and the ladder drums becomes greater, whereby the ladder lifting and lowering motion becomes heavier and less smoother; and, in case where the fitting tightness between the ladder rings and the ladder drums is set looser for a lighter slat lifting and lowering motion, slat tilting responsiveness becomes poorer. The present invention is made to solve such problems.

SUMMARY OF THE INVENTION

It is therefore an object of the present invention to provide an apparatus for tilting and lifting slats of a slat-ladder for a venetian blind, equipped with a shaft rotation stopping mechanism which enables the inside width from the front to the rear sides of the head box to be not greater than the outer diameter of the lifting drum cover.

It is another object of the present invention to provide an apparatus for titling and lifting slats of a slat-ladder for a venetian blind, which enables both of a better slat tilting responsiveness and a lighter slat lifting motion to occur with a single apparatus.

According to the present invention, there is provided an apparatus for lifting and tilting slats of a slat-ladder for a venetian blind, which comprises: a head box; a rotating shaft; a first and a second ladder drums rotating together with the shaft; a first and a second drum holders for supporting the first and the second ladder drums; a first and a second ladder rings having an open ring shape and fitted around each of the first and second ladder drums; ladder cords being respectively put on, and secured to, each of the first and second ladder rings; lifting drums; lift cords, wound around each of the lifting drums; slats, supported by the ladder cords; and means for stopping the rotation of said shaft. The apparatus is characterized in that the means for stopping the rotation of the shaft comprises: a stopper holder, fixed on a head box; a drum stopper of a ring shape, axially not slidably, but rotatably, attached to the stopper holder; a stop ring of a ring shape, axially slidably, but not rotatably, attached to the stopper holder; and a spring for axially pressing the stop ring against the drum stopper. The drum stopper and the stop ring have teeth respectively formed on the mutually opposite ends of the drum stopper and the stop ring so that the teeth are engageable with each other. The lifting drum is disposed through the inside of the drum stopper and the stop ring. The lifting drum has the drum stopper engaged therewith utilizing an axial slot thereof so that the drum stopper rotates together with the lifting drum. Each of the lift cords is put on the stop ring, and is hung downward.

In one embodiment, the apparatus is characterized in that the first and second ladder rings respectively have a release ring disposed to be adjacent thereto. The release ring is loosely fitted around each of the first and second ladder drums. The release ring has an axial protrusion and an outward protrusion from the outer circumference thereof, respectively disposed thereon. The first and second drum holders have first and second stoppers respectively disposed thereon so that the first and second stoppers respectively limit the range of rotation of the release ring by engaging with the outward protrusion of the release ring. The axial protrusion of the release ring is inserted in each ring opening of the first and second ladder rings. The ladder rings are fitted to the ladder drums relatively tightly. In the case where a lifting drum cover is used, the ladder ring may be formed on one end of the lifting drum cover.

Arranged in accordance with the present invention, as described above, the means, or mechanism, for stopping the rotation of the rotating shaft when any of the lift cords is slackened, comprises: a stopper holder, fixed on a head box; a ring-shaped drum stopper rotating together with the lifting drum, and axially not slidably, but rotatably, attached to the stopper holder; a ring-shaped stop ring releasably engaging with the drum stopper, and axially slidably, but not rotatably, attached to the stopper holder; and a spring for axially pressing the stop ring against the drum stopper, the lift cords wound around the lifting drum being put on the stop ring, then hung downward, so that, in the case where the lift cord is tightened, the lift cord axially separates the stop ring from the drum stopper, resisting the spring force, and in the case where the lift cord is slackened, the spring force presses the stop ring into an engagement with the drum stopper, whereby the shaft is stopped.

Therefore, there is no need for either the drum stopper or the stop to have a greater width from the front to the rear sides than the width of the lifting drum cover of prior mechanism. Subsequently, the width of the head cover from the front to the rear sides, according to the present invention, is smaller in comparison with the prior mechanism having a ratchet wheel with a diameter greater than the lifting drum cover, whereby, a better appearance and less restriction for the installation space are obtained, as significant advantages.

Furthermore, in one embodiment according to the present invention, as described above, the apparatus performs the tilting, and lifting or lowering motions in a fashion that: as fare as the slats are within an allowable range of tilting, the ladder rings are tightly fitted around the ladder drums; once the slats reach the tilting limit, the axial protrusions of the release rings, inserted in each ring opening of the ladder rings, forces the ladder ring to open so that the fitting tightness between the ladder rings and the ladder drums becomes looser.

Therefore, in comparison with the prior apparatus, in which the fitting tightness is always constant between the ladder rings and the ladder drums, the apparatus, according to the present invention, effects another set of significant advantages including: a better tilting responsiveness to the rotating motion of the shaft due to a tighter fitting between the ladder rings and the ladder drums during the tilting; and a lighter lifting and lowering motion due to a looser fitting between the ladder rings and the ladder drums during the lifting and lowering.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
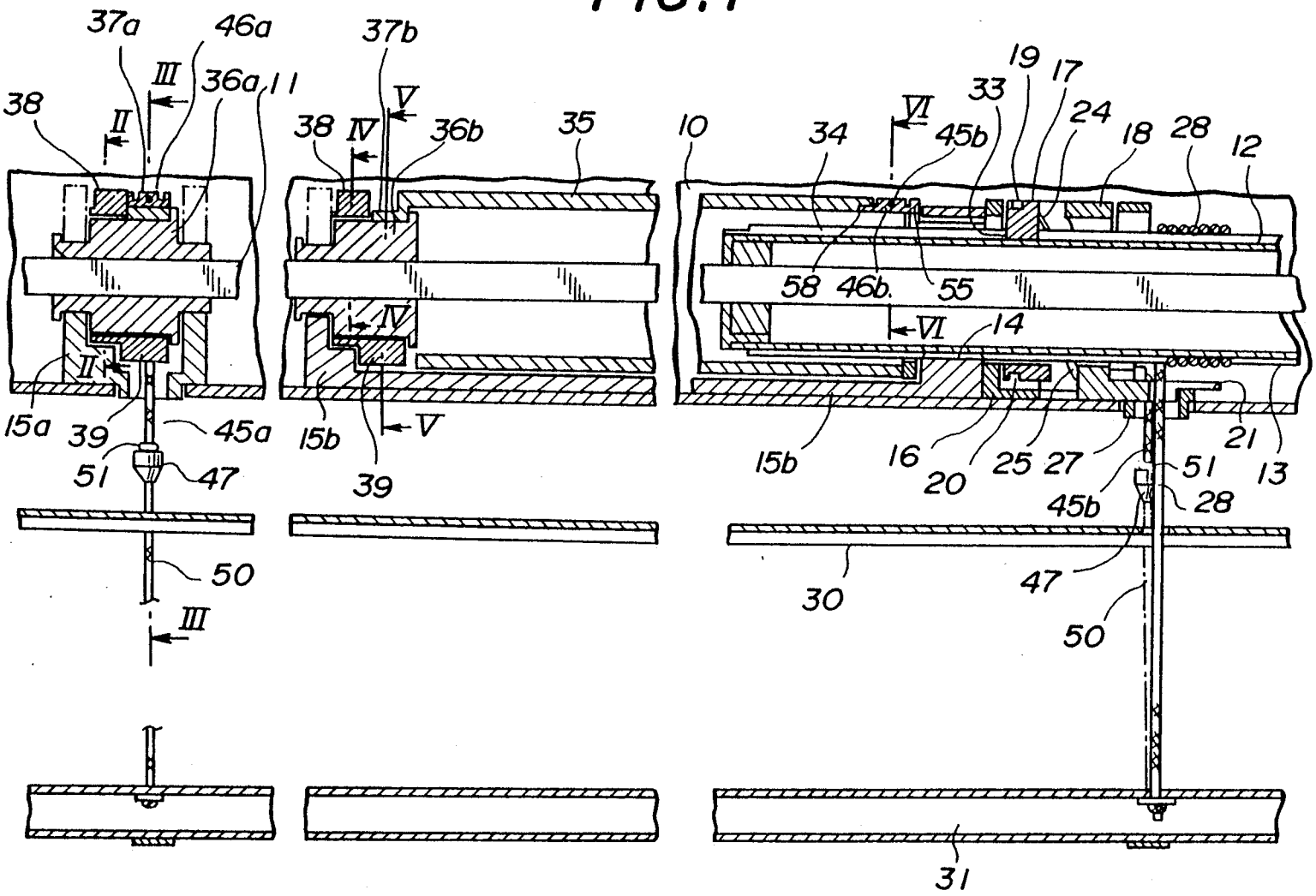
FIG. 1 is a partially cross-sectional, front elevational view of a major part of a venetian blind equipped with apparatus for lifting and tilting slats in a venetian blind according to an embodiment of the present invention.
Figure 2:
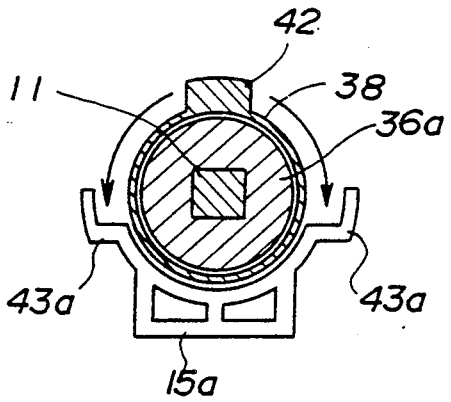
FIGS. 2 and 3 are cross-sectional views of the apparatus of FIG. 1 taken along the lines II—II and III—III, respectively, of FIG. 1.
Figure 4:
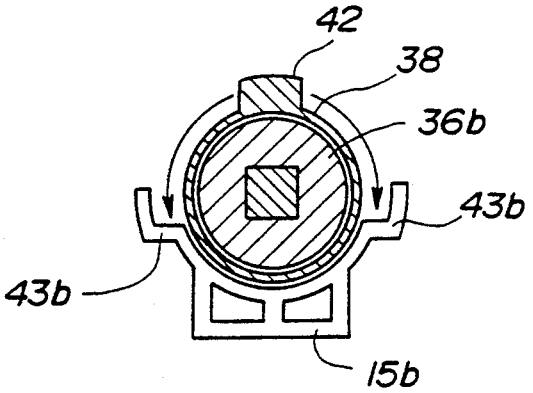
FIGS. 4, 5 and 6 are cross-sectional views of the apparatus of FIG. 1 taken along the lines IV-IV, V—V and VI—VI, respectively, of FIG. 1.

The present invention will be described, in detail, according to embodiments referring to the accompanying drawings.

In a venetian blind, as shown in FIGS. 1 to 6, a rotating shaft 11 having a square-shaped cross-section is disposed through in a head box 10 in the longitudinal direction. The rotating shaft 11 is rotatably driven by hand or a motor. A first and a second ladder drums 36*a*, 36*b* are fitted along and around the shaft 11 so as to rotate together with the shaft 11. The ladder drums are supported by a first and a second drum holders 15*a*, 15*b*, which are fixed to the head box 10. A first ladder ring 37*a* having an open ring shape, and a release ring 38, are respectively fitted around the first ladder drum 36*a*. The fitting tightness is relatively tight for the first ladder ring 37*a*, and relatively loose for the release ring 38. The release ring 38 has an axial protrusion 39 disposed thereon and inserted in the opening of the first ladder ring 37*a*. The first ladder ring 37*a* has a first fixture 46*a* of a first auxiliary ladder cord 45*a* secured to the top center of the first ladder ring 37*a*. Both ends of the first auxiliary ladder cord 45*a* run along the front and the rear side surfaces of the first ladder ring 37*a*, then, hang downward from a first opening frame 41 of the first drum holder 15*a* which protrudes from the bottom of the head box 10. A release ring 38, and a second ladder ring 37*b* formed on one end of a lifting drum cover 35 are respectively fitted around the second ladder drum 36*b*. The fitting tightness is relatively tight for the first ladder ring 37*b*, and relatively loose for the release ring 38. The release ring 38 has an axial protrusion 39 disposed thereon and inserted in the opening of the second ladder ring 37*b*. The lifting drum cover 35 extends axially from the one end to the other end, where the fixture 46*b* of a second auxiliary ladder cord 45*b* is secured via a slit. A drum washer 55 is disposed adjacent to the second auxiliary ladder cord 45*b*. The other end of the second drum holder 15*b* is disposed adjacent to the drum washer 55. Female screw threads 14 are formed on the other end of the second drum holder 15*b* to engage with male screw threads 13 of the lifting drum 12. Both ends of the second auxiliary ladder cord 45*b* are pulled around, in a manner to be described later, then, hang downward from a second opening frame 27, of a stopper holder 16, which provides from the bottom of the head box 10. Connectors 47 are respectively attached integral to the both ends of the auxiliary ladder cords 45*a*, 45*b*. Loops 51 disposed at the upper end on the front and the rear sides of main ladder cords 50, are connected to the connectors 47. The main ladder cords 50 support the slats 30 via wefts which constitute the ladder. A bottom rail which constitutes the slat of the lowest stage, is hung by the lift cords 28.

Figure 7:
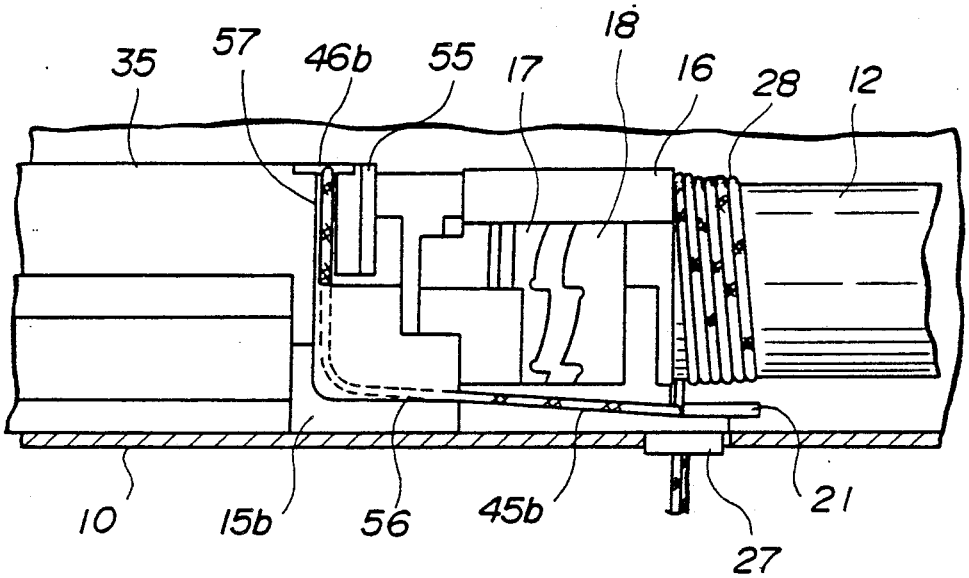
FIG. 7 is a partial front elevational view of the apparatus of FIG. 1 the head box shown partially broken, illustrating a pulled-around auxiliary ladder cord.
Figure 13:
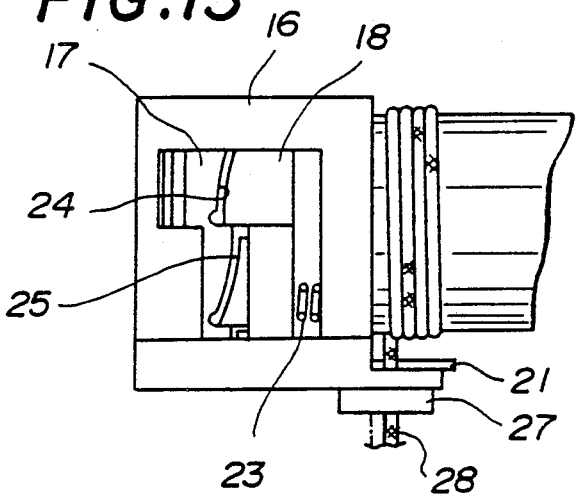
FIGS. 13 and 14 are a partial front elevational view and a partial bottom plan view, respectively, of the apparatus of FIG. 1, illustrating the lift cord in a slackened state.
Figure 14:
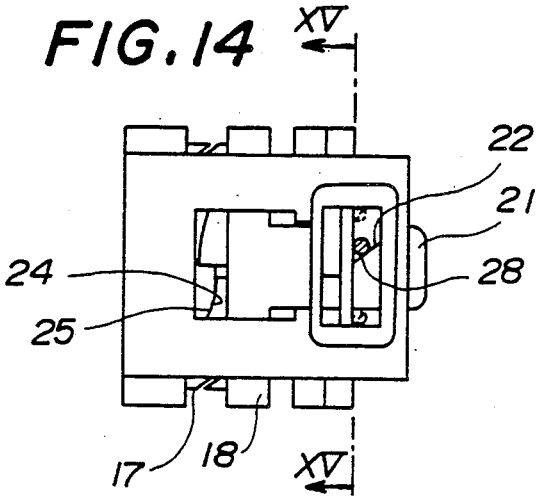
Figure 15:
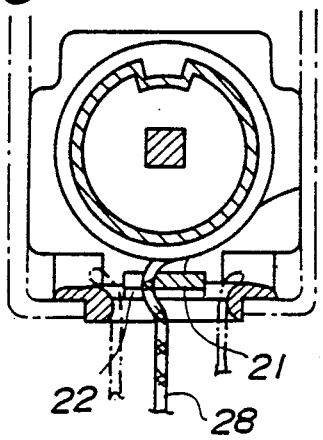
FIG. 15 is a cross-sectional view taken along the line XV—XV, of FIG. 14.

As shown in FIGS. 1 and 7, the stopper holder 16 is fixed to the head box, adjacent to the other end of the second drum holder 15*b*. A drum stopper 17 and a stop ring 18 are attached to the stopper holder 16, through which the shaft 11 and the lifting drum 12 are disposed. The drum stopper 17 is arranged to be rotatable together with the lifting drum 12, but not axially slidable. The stop ring 18 is arranged to be not rotatable, but axially slidable. The stop ring 18 is pressed against the drum stopper 17 by the force of a spring 23 (FIG. 13). The loft cord 28, wound around the lifting drum 12, is put on a tail 21 of the stop ring 18, then, hangs downward below the head box 10 from the second opening frame 27 of the stopper holder 16, and reaches the bottom rail which constitutes the slat of the lowest stage. When the lift cord is tightened, the stop ring 18 is separated from the drum stopper 17, and, subsequently, the lifting drum 12 rotates together with the shaft 11. When the lift cord is slackened, the stop ring 18 engages with the drum stopper 17, and, subsequently, the rotation of the lifting drum 12 and the shaft 11 is blocked.

Figure 6:
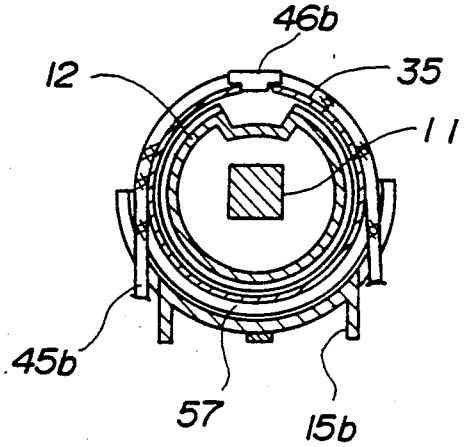

As shown in FIGS. 6 and 7, the second auxiliary ladder cord 45*b* is put on, and secured via the second fixture 46*b* to, between the other end of the lifting drum cover 35 and the drum washer 55. The both ends of the second auxiliary ladder cord 45*b* run, along a guide groove 57 of the lifting drum cover 35 and guide grooves 56 of the drum 15*b*, into the stopper holder 16, then, hang downward below the head box 10 from the second opening frame 27 of the stopper holder 16, so as to be aligned with the lift cords 28, respectively in line, from the front to the rear sides.

Figure 3:
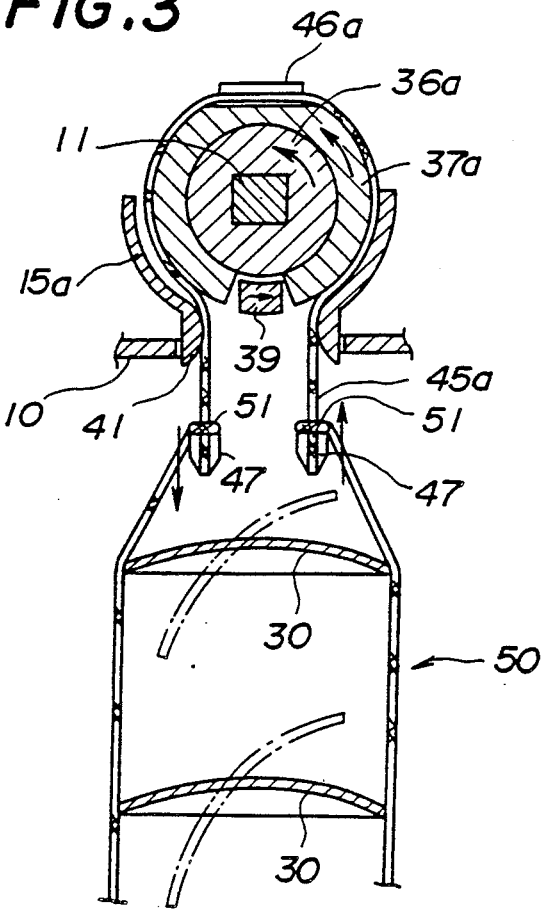
Figure 5:
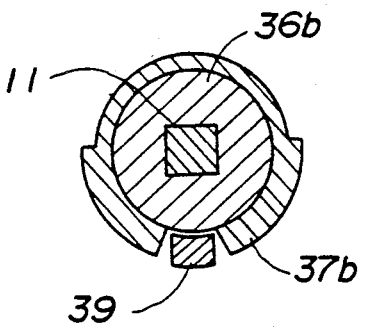

In the arrangement described above, when the shaft 11 is rotated in the direction indicated by the arrow shown in FIG. 3, the ladder drums 36*a* and 36*b* rotate together. As described above, the ladder rings 37*a*, 37*b* are relatively tight fitted around the ladder drums 36*a*, 36*b*. Therefore, is the beginning, the first ladder ring 37*a*, and the lifting drum cover 35 integral with the second ladder ring 37*b*, rotate directly together with the shaft 11 without any slipping between the ladder rings 37*a*, 37*b*, and the ladder drums 36*a*, 36*b*. Subsequently, the front and the rear sides of the auxiliary ladder cords, and of the main ladder cords are shifted to the opposite directions with each other, whereby the slats are tilted.

In the beginning, the release rings 38 also rotate together with the ladder rings 37*a*, 37*b*, and the shaft 11, since the release rings 38 have the axial protrusions thereof inserted in the opening of the ladder rings 37*a*, 37*b*. As indicated by the arrows shown in FIGS. 2 and 4, however, the release rings 38 can only rotate, or turn, for a range limited by the stoppers 43*a* or 43*b* where the outward protrusions 42 of the release rings 38 are respectively engaged and stopped. In this embodiment, the rotational limits are set at 90 degrees each, either to the front side, or to the back side. When the outward protrusions 42 are respectively engaged with, or blocked by, the stoppers 43*a*, 43*b*, the release rings 38 are stopped. While the first and second ladder rings 37*a* and 37*b*, and the lifting drum cover 35, tend to continue rotating as the shaft is further being rotated, the axial protrusions 39, of the release rings 38, which are inserted in the opening of the ladder rings 37*a*, 37*b*, not only block the rotation of the ladder rings 37*a* and 37*b*, and the lifting drum cover 35, but also force the ring portion of the ladder rings 37a, 37b, to open wider, thereby loosening the fitting tightness between the ladder rings 37a, 37b, and the ladder drums 36a, 36b. At this stage, the tilting of the slats 30 also reaches the limit. For the slat-ladder lifting or lowering operation, the shift 11 is further being rotated under the condition of this stage, in which the ladder rings 37a, 37b, are opened wider by the axial protrusion 39 so that the fitting tightness thereof with the ladder drums 36a, 36b is reduced. Thus, the frictional resistance between the ladder drums 36a, 36b, and the ladder rings 37a, 37b, is respectively reduced, whereby the shaft 11 and the lifting drum 12 can be rotated lightly for winding up or winding down the lift cords.

As described above, according to the present invention, within the rotational range of the release ring 38, or the tilting range of the slats 30, the ladder rings 37a, 37b, are tightly fitted to the ladder drums 36a, 36b, so that no slipping occurs therebetween, and, subsequently, the ladder rings 37a, 37b, substantially together with the ladder drums 36a, 36b.

Therefore, an advantage is obtained in that the responsiveness of the slat tilting to the shaft rotation is significantly improved, in comparison with the prior art in which the ladder rings are fitted with the ladder drums under a constant fitting tightness allowing slippage therebetween.

Furthermore, when the slats reach their tilting limit, the ladder rings 37a, 37b, are opened wider, and the fitting tightness thereof with the ladder drums 36a, 36b, is loosened, and, subsequently, the frictional resistance therebetween is reduced, as described above.

Therefore, another advantage is obtained in that, after the slats 30 reach their limit, the shaft 11 can be rotated significantly lighter, in comparison with the prior art in which the ladder rings are fitted with the ladder drums under a constant frictional resistance. Thus, the torque required for lifting and lowering the slat-ladder is reduced.

In the apparatus according to the present invention, the second ladder ring 37b, on which the second auxiliary ladder cord 45b is put on, and secured, can be tightly fitted around the ladder drum 36b, regardless of the torque required for rotating the shaft 11 to lift and lower the slats. Thus, an arrangement, as shown in FIG. 7, is obtained to which, while the lift cord 28 is hung directly from the lifting drum 12, the second auxiliary ladder cord 45b may be pulled around, along the guide groove 57 of the lifting drum cover 35 and the guide grooves 56 of the drum holder 15b, then, to the positions aligned with said lift cords 28, respectively in line, from the front to the rear sides.

Figure 8:
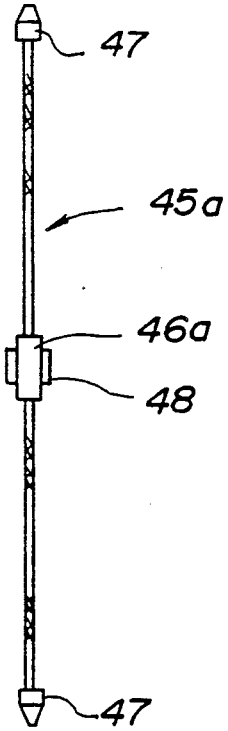
FIG. 8 is a development of an auxiliary ladder cord.
Figure 9:
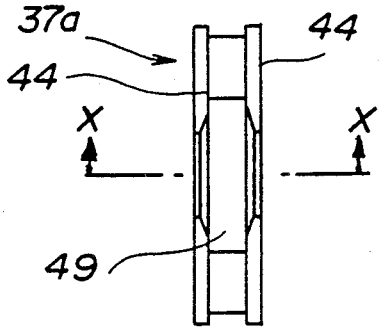
FIG. 9 is a plan view of a ladder ring.
Figure 10:
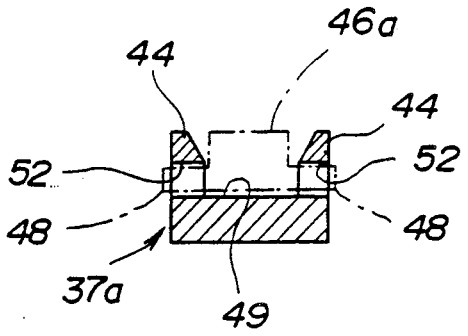
FIG. 10 is an enlarged cross-sectional view taken along the line X—X, of FIG. 9.

As shown in FIG. 8, the fixture 46a is disposed in the central portion of the first auxiliary ladder cord 45a, which is equipped with connectors 47 on the both ends thereof. The mixture 46a has a plate shape, and has side protrusions 48 oppositely formed with each other. As shown in FIGS. 9 and 10, the fixture 46a corresponds to a flat portion 49 formed between flanges 44 on the top of the circumference of the first ladder ring 37a. The retaining holes 52 are formed axially in line through the flange portions 44 at a position corresponding to the flat portion 49. The side protrusions 48 respectively fit in the retaining holes 52. The first ladder ring 37a is made of plastic material having elasticity, and the flanges 44 are formed to have a slant inside surface. Thus, the flanges 44 can be easily elastically opened, then, the fixture 46a is settled on the flat portion 49, and the side protrusions 48 are fitted in the retaining holes 52, by a pressing motion of the fixture 46a against the flat portion 49, with the side protrusions 48 held along the side flanges 44.

Figure 16:
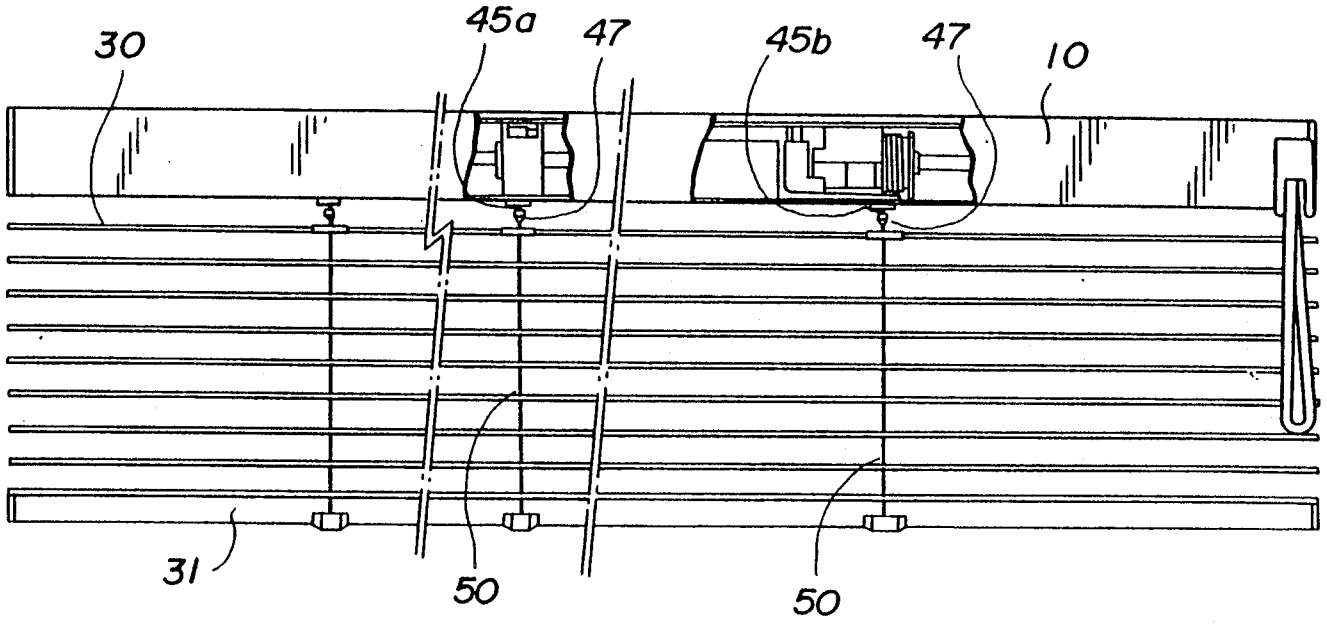
FIG. 16 is a front elevational general view of a venetian blind, equipped with the apparatus according to the present invention.

FIG. 16 shows a front elevational general view of a venetian blind, equipped with the apparatus according to the present invention. The main ladder cords 50 are hung from the connectors 47 of the auxiliary ladder cords 45a, 45b, which hang from the head box 10. The main ladder cords 50 support all the slats 30, or slat-ladder, and the bottom rail 31. The assembling or disassembling of the main ladder cords 50 and the auxiliary ladder cords 45a, 45b is simple and easy.

Thus, still another advantage is obtained in that inspection and cleaning of the slats, or the slat-ladder may be conducted very easily, by removing all the slats 30 and the bottom rail 31, together with the main ladder cords 50, from the head box 10, while leaving the head box 10 as installed. The assembling and disassembling of the auxiliary ladder cords is also simple and easy, as described above.

Figure 11:
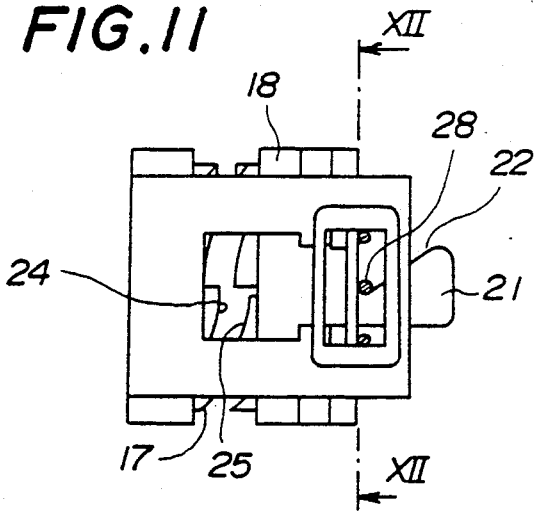
FIG. 11 is a partial bottom plan view of the apparatus of FIG. 1, illustrating the lift cord in a tightened state.
Figure 12:
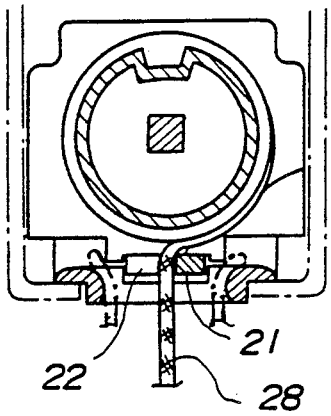
FIG. 12 is a cross-sectional view taken along the line XII—XII, of FIG. 11.

In the venetian blind shown in FIG. 1, an outer circumferential groove 19 of the drum stopper 17 is fitted to a semicircular protrusion 20 disposed on the stopper holder 16. Thus, the drum stopper 17 is not axially slidable, while being rotatably supported. The drum stopper 17 has an inner circumferential protrusion 33, which is fitted in an axial slot 34 disposed on the lifting drum 12, whereby the drum stopper 17 rotates together with the lifting drum 12. The stop ring 18 has a tail 21, as described above, which extends axially in the direction opposite to the drum stopper side. As shown in FIGS. 11 and 12, the tail 21 has a V-shaped slant groove 22 disposed thereon. One of the two sides of the slant groove 22 is arranged to be at a right angle with the direction in which the tail 21 extends, or the axial direction, while the other side constitutes a slant surface intersecting the right-angled side. The stop ring 18 is arranged to be slidable axially within a predetermined distance, while being not rotatable. As shown in FIG. 13, and described earlier, spring 23 is disposed between the stop ring 18 and the stopper holder 16. The spring 23 axially presses the stop ring 18 against the drum stopper 17. The stopper holder 16 has opening frame 27 disposed to be fitted in a bottom opening 26 of the stopper holder 16. The tail 21 is positioned over the opening frame 27. The lift cord 28, wound on the lifting drum 12, is put on the slant groove 28, then, is hung downward via the opening frame 27. Since the slant groove 22 is formed so that the groove is shallow at the outermost point and deep at the innermost point, when the lift cord 28 is tightened by the load of the bottom rail 31, as shown in FIG. 1, the lift cord 28 pushes the slant groove 22, and, subsequently, the tail 21, axially to the right in FIG. 11, and as also shown in FIG. 12, resisting the force of the spring 23, so that the engaging teeth 24, 25 of the stop ring 18 and the drum stopper 17 are separated. Then, the drum stopper 17 rotates without restriction. To the contrary, in the case where the bottom rail 31 is blocked from lowering, and the lift cord 28 is slackened, the spring 23 presses the stop ring 18 against the drum stopper 17 so that the teeth 24, 25 are engaged again, whereby the rotation of the drum stopper 17 and the lifting drum 12, which is coupled with the drum stopper 17, and the shaft 11 is blocked. In this case, the lift cord 28 is moved in the direction vertical to the axial direction, by the slant groove 22 of the tail 21.

Thus, if the bottom rail 31 is unevenly blocked by an obstacle, and the lift cord on one side is slackened, the shaft immediately stops rotating, whereby the uneven lowering of the slats is prevented from occurring.

In the arrangement of the shaft rotation stopping mechanism, described above, there is no need to set the outer diameter, or the width from the front to the rear sides, of the drum stopper 17 and the stop ring 18, at a value greater than the lifting drum cover 35. Therefore, the inside width from the front to the rear sides of the head box may be only slightly greater than the outer diameter of the lifting drum cover 35.

Therefore, the head box 10 according to the present invention, can be significantly reduced in the width from the front to the rear sides thereof, in comparison with the prior art in which a ratchet wheel is fitted around the lifting drum, and, subsequently, the inside dimension of the head box has to be greater than the outer diameter of the ratchet wheel.

Thus, still other advantages are obtained which include a better appearance and less restrictions for the installation space.

What is claimed is:

1. Apparatus for lifting and tilting slats of a slat-ladder in a venetian blind, comprising: a head box (10); a rotating shaft (11) disposed on said head box so as to be rotatably driven; first and second ladder drums (36*a*, 36*b*) disposed along said shaft so as to rotate together with said shaft; first and second drum holders (15*a*, 15*b*) fixed to said head box and respectively supporting said first and second ladder drums; first and second ladder rings (37*a*, 37*b*), each having an open ring shape and fitted around each of said first and second ladder drums; ladder cords (45*a*, 45*b*, 50), respectively put on, and secured to, each of said first and second ladder rings; lifting drums (12) rotating together with said shaft and having the outer circumference thereof screwed into said second drum holder; lift cords (28) respectively wound around each of said lifting drums; slats (30) supported by said ladder cords; and means for stopping the rotation of said shaft in the case where said lift cord is slackened;

said means for stopping the rotation of said shaft, comprising:

a stopper holder (16) fixed on said head box;

a drum stopper (17) of a ring shape, axially not slidably, but rotatably, attached to said stopper holder;

a stop ring (18) of a ring shape, axially slidably, but not rotatably, attached to said stopper holder; and a spring (23) for axially pressing said stop ring against said drum stopper;

said drum stopper and said stop ring having teeth (24, 25) respectively formed on the mutually opposite ends of said drum stopper and said stop ring so that said teeth are engagable with each other;

said lifting drum being disposed through the inside of said drum stopper and said stop ring;

said lifting drum having said drum stopper engaged therewith utilizing an axial slot thereof so that said drum stopper rotates together with said lifting drum;

each of said lift cords being put on said stop ring and being hung downward;

whereby, said lift cord, when tightened, separates said stop ring from said drum stopper, resisting said spring force, and said lift cord, when slackened, enables said spring to press said stop ring toward said drum stopper to have teeth engaged with each other.

2. Apparatus according to claim 1, wherein said second ladder ring (37*b*) is formed together to constitute a part of a lifting drum cover (35).

3. Apparatus according to claim 2, wherein said ladder cords respectively complete first auxiliary ladder cords (45*a*), second auxiliary ladder cords (45*b*), and main ladder cords (50), said first and second auxiliary ladder cords respectively being put on, and secured to, said first ladder ring (37*a*), and said lifting drum cover (35) formed integral with said second ladder ring (37*b*), said main ladder cords having upper ends thereof connected to both lower ends of said first and second auxiliary ladder cords on the front and rear sides of the apparatus below said head box.

4. Apparatus according to claim 3, wherein said second auxiliary ladder cords (45*b*), put on, and secured to, said lifting drum cover (35) formed integral with said second ladder ring (37*b*), are pulled around in accordance with guide grooves (56) disposed on said second drum holder (15*b*) so that said second auxiliary ladder cords (45*b*) hang from said head box (10) downward, aligned with said lift cords (28), respectively in line, from the front to the rear sides, said lift cords (28) hanging downward directly from said lifting drum (12).

5. Apparatus according to claim 3, wherein said second ladder ring (37*a*) has each of two flange portions (44) formed on both the axial ends thereof, said second ladder ring (37*a*) further having a chord-like, horizontally flat portion (49) formed on the top of the circumference thereof, said flange portions having two retaining holes (52) formed axially in line through said flange portions at a position corresponding to said flat portion, said first auxiliary ladder cords having a plastic center fixture (46*a*) and plastic connectors (47) respectively formed at the center and on both ends thereof to be integral therewith, said fixture being formed to be of a shape fitting in said flat portion of said ladder ring, said fixture having side protrusions (48) oppositely formed with each other to be integral therewith so that said side protrusions respectively fit in said retaining holes.

6. Apparatus according to claim 1, wherein said first and second ladder rings (37*a*, 37*b*) respectively having a release ring (38) disposed to be adjacent thereto, said release ring being loosely fitted around each of said first and second ladder drums, said release ring having an axial protrusion (39) and an outward protrusion from the outer circumference thereof disposed thereon, said first and second drum holders having first and second stoppers respectively disposed thereon so that said first and second stoppers respectively limit the range of rotation of said release ring by engaging with said outward protrusion of said release ring, said axial protrusion of said release ring being inserted in each ring opening of said first and second ladder rings of an open ring shape.

* * * * *